US006213023B1

(12) United States Patent
Gunners

(10) Patent No.: US 6,213,023 B1
(45) Date of Patent: Apr. 10, 2001

(54) BASE BLEED UNIT

(76) Inventor: Nils-Erik Gunners, Furudalsvägen 10, Västerhaninge (SE), S-137 34

( * ) Notice: Subject to any disclaimer, the term of this patent is extended or adjusted under 35 U.S.C. 154(b) by 0 days.

(21) Appl. No.: 09/319,263

(22) PCT Filed: Dec. 9, 1997

(86) PCT No.: PCT/SE97/02064

§ 371 Date: Jun. 14, 1999

§ 102(e) Date: Jun. 14, 1999

(87) PCT Pub. No.: WO98/26249

PCT Pub. Date: Jun. 18, 1998

(30) Foreign Application Priority Data

Dec. 13, 1996 (SE) ..... 9604613

(51) Int. Cl.[7] ..... F42B 10/40

(52) U.S. Cl. ..... 102/490; 102/202; 102/380; 60/256

(58) Field of Search ..... 102/202, 374, 102/376, 380, 490, 513; 60/253, 255, 256

(56) References Cited

U.S. PATENT DOCUMENTS

| | | | | |
|---|---|---|---|---|
| 3,387,560 | * | 6/1968 | Mertens | 102/376 |
| 3,698,321 | * | 10/1972 | Wall | 102/374 |
| 4,213,393 | | 7/1980 | Gunners et al. | 102/49.3 |
| 4,807,532 | | 2/1989 | Andersson et al. | 102/490 |
| 4,807,535 | * | 2/1989 | Schilling et al. | 102/490 |
| 4,846,071 | | 7/1989 | Franzen et al. | 102/490 |

FOREIGN PATENT DOCUMENTS 340076 10/1975 (SE) .

* cited by examiner

*Primary Examiner*—Harold J. Tudor
(74) *Attorney, Agent, or Firm*—Jacobson, Price, Holman & Stern, PLLC

(57) ABSTRACT

Base bleed unit comprising a surrounding housing (1) surrounding at least one mass flow generating gun powder charge (7), and having at least one outlet hole (6, 6') extending through a rear wall (3) of the housing (1), in which also at least one igniter charge (4) is arranged. According to the invention, an internal and the rear wall (3) adjacent portion of the mass flow generating gun powder charge (7) is arranged abutting a preferably substantially conically narrowing supporting wall surface extending from the rear wall (3). The preferably substantially conically narrowing supporting wall surface may comprise a centrally located member (5), extending from and integrated with the internal surface of the rear wall (3) of the base bleed unit, arranged to act as a supporting surface with its external surface, or with such a member attached to said internal surface. The preferably substantially conically narrowing wall surface may also comprise a collar shaped member. The rear wall (3) of the surrounding housing (1) is advantageously arranged with a substantially centrally located through hole, in which the igniter charge (4) is mountable/demountable from the outside plane of the rear wall (3).

10 Claims, 3 Drawing Sheets

BASE BLEED UNIT

Figure 1A:
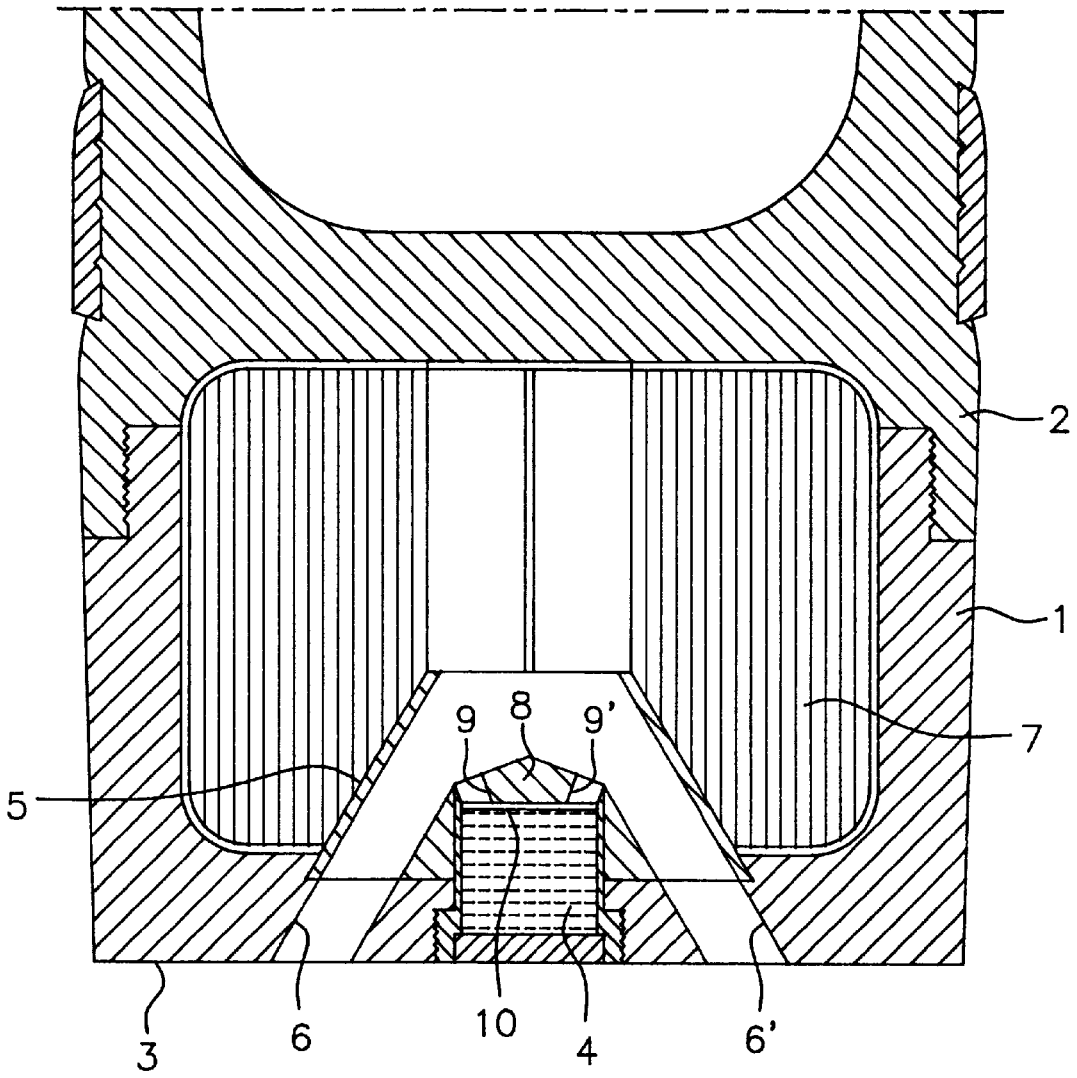

The present invention relates to a base bleed unit.

A base bleed unit is previously known, for example by SE-A-340 076, whereby for example an artillery projectile can be given an increased shooting range by a reduction of the air drag at the base plane of a projectile by means of the so called base-bleed-action. According to this previously known arrangement, a base bleed unit includes a gun powder charge for generation of desired mass flow, and an igniter charge located in an opposed relationship to a gas outlet opening.

A similar type of a base bleed unit is disclosed in U.S. Pat. No. 4,213,393. A further developed base bleed unit is disclosed in U.S. Pat. No. 4,807,532, and is primarily different from the above mentioned and previously known solutions by the location of the igniter charge adjacent to the base plane, i.e. the plane by which the mass flow is ejected. According to a preferred embodiment, the igniter charge is centrally located, and having a number of surrounding outlet holes for the base drag reducing gas generated by existing gun powder charge.

The object of the present invention is to disclose a base bleed unit, improved in relation to prior art, which removes the problems caused by deformation of the mass flow generating gun powder charge due to influence of acceleration forces. To locate the igniter charge in an opposed relationship to an outlet opening as disclosed in SE-A-340 076 or U.S. Pat. No. 4,213,393 results in a considerably reduced ignition effect as compared to a location adjacent to an outlet opening, since, for example, the combustion flame from the igniter charge is guided towards existing outlet openings at the base plane, and problems also occur in case that the igniter charge should become loose under influence from acceleration forces. In the embodiment according to U.S. Pat. No. 4,807,532, the mass flow generating gun powder charge may, due to deformation caused by acceleration partly or completely cover the outlet nozzles, and thereby change intended flow properties. Problems caused by this deformation have also resulted in restrictions with regard to allowed muzzle speed for projectiles arranged with known types of base bleed units, and thus a reduced trajectory length. According to the present invention, a preferred location of the igniter charge is provided in combination with an extremely good support for the mass flow generating gun powder charge, which on one hand secures good ignition of the gun powder charge, and on the other hand prevents formation of cracks and damage to the gun powder charge. This results in accurate control of the trajectory length and extremely small dispersion, which are most desirable features. Furthermore, the drive charge of the weapon can be arranged without previous restrictions related to muzzle speed, which results in a possibility to a further increase of the trajectory length. The present invention also discloses an advantageous way of locating the igniter charge of the base bleed unit. The base bleed unit according to the present invention also facilitates improved possibility of choosing suitable chemical composition of the mass flow generating gun powder charge as well as the igniter charge due to the very favourable supporting properties offered for both the gun powder charge and the igniter charge.

The base bleed unit according to the present invention comprises a surrounding housing surrounding at least one mass flow generating gun powder charge, and having a number of outlet holes extending through a rear wall of the housing surrounding a substantially centrally arranged igniter charge adjacent to said rear wall, and it is mainly characterized in that a centrally located member, which substantially has the shape of a truncated cone, is arranged extending from the internal surface of the rear wall, arranged abutting a portion of the mass flow generating gun powder charge adjacent in relation to the rear wall, said member also surrounding the outlet holes and the igniter charge.

Figure 1B:
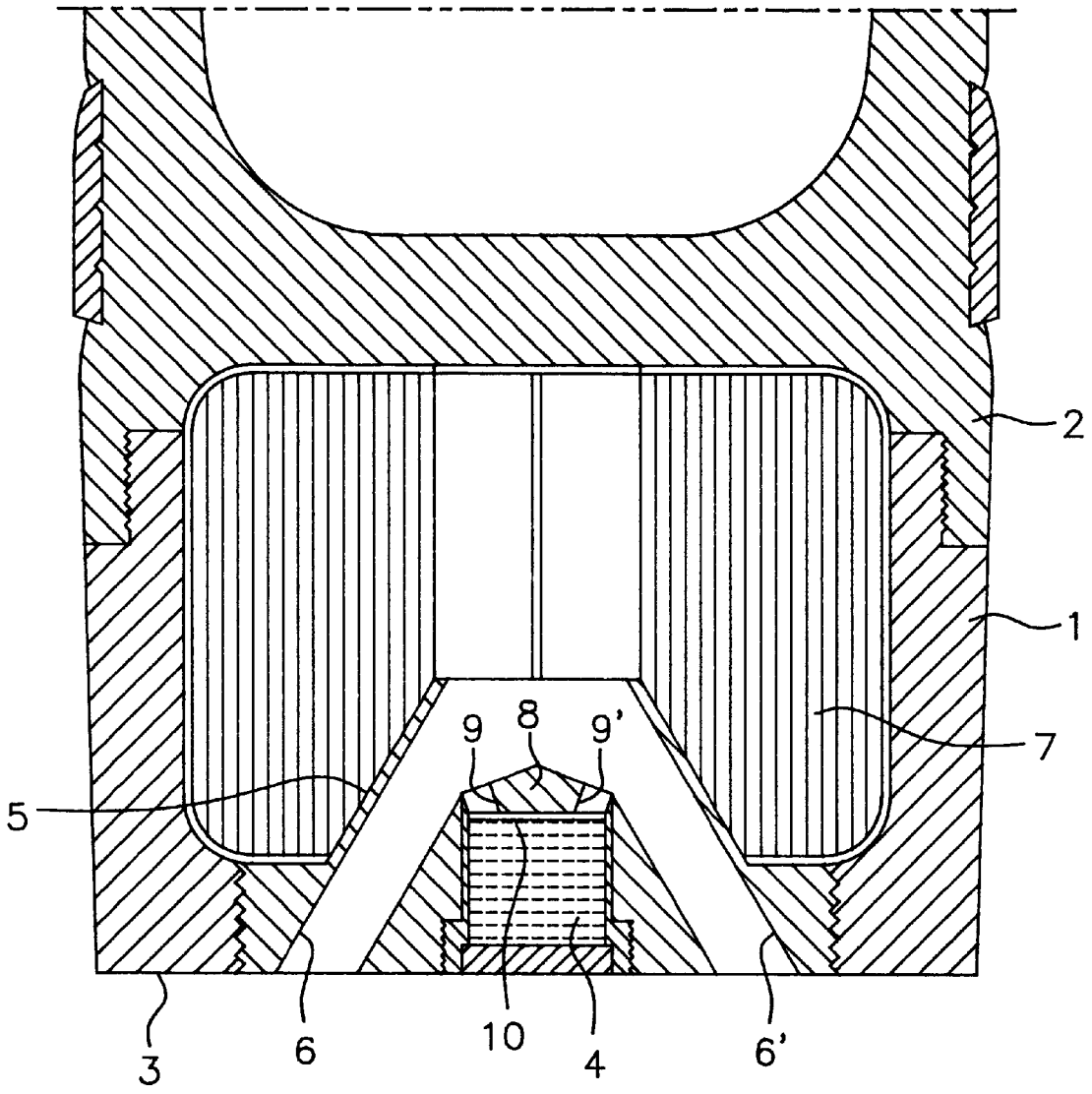
Figure 2:
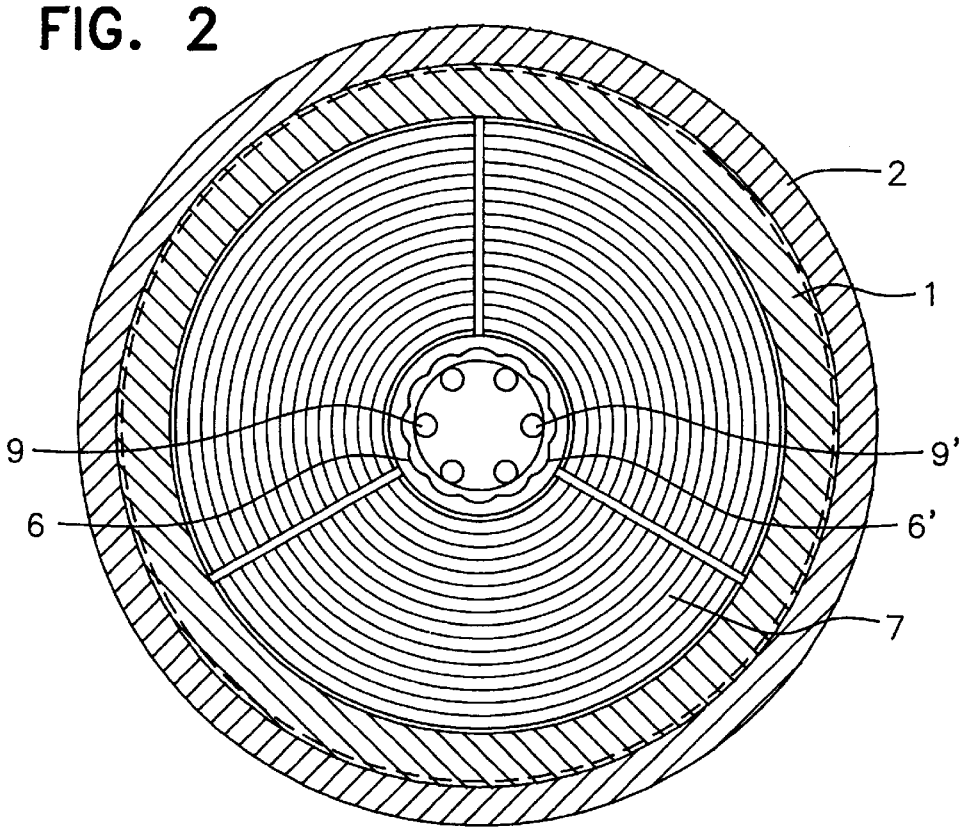
Figure 3:
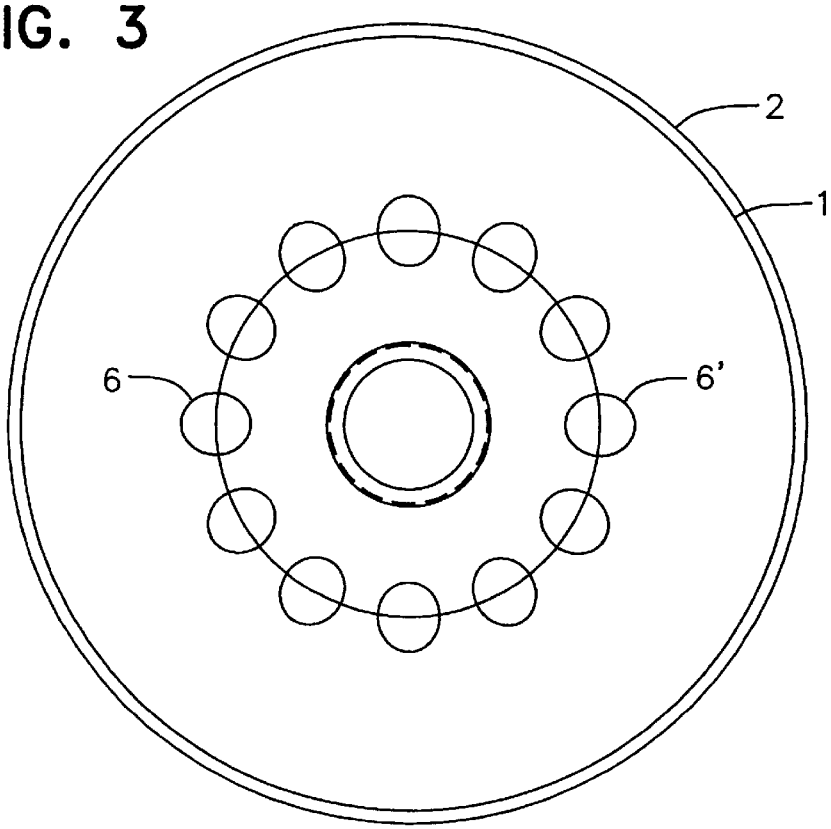

A non-restricting example of an embodiment of a base bleed unit according to the present invention is more fully described below with reference to the accompanying drawings, in which: 1, 1A and 1B show views; and in longitudinal section of the rear portion of a projectile with an examples of embodiments of a base bleed unit according to the invention;

FIG. 2. shows a cross-sectional view at the sectional line A—A in FIG. 1; and FIG. 3 shows a view of the end plane of the base bleed unit shown in FIG. 1.

With reference to FIG. 1, the base bleed unit includes a surrounding housing, as an entire unit denominated 1, attached to the rear end portion of a projectile body 2. The housing 1 has a rear wall 3, the inside surface of which having a centrally located hole, which surrounds an igniter charge 4. The inside central portion of the rear wall 3 is arranged as a truncated cone 5 extending towards the projectile body 2, surrounding a number of outlet holes 6, 6', inclined in relation to the length axis of the base bleed unit and having the outlet openings located more adjacent to the peripheral portion of the base bleed unit than the inlet openings. The conical surface of the central portion 5 forms a supporting surface for the lower part of a mass flow generating gun powder charge 7.

During a launching sequence, the gun powder charge 7 and the igniter charge 4 are ignited by the hot combustion gases from the drive charge in the weapon, and the combustion flame of the igniter charge 4 is directed into and along the inside surface of the substantially tubular mass flow generating charge. 7, and maintains the ignition of said gun powder charge 7 at the extreme pressure drop which occurs during muzzle exit. The acceleration forces imposed on the gun powder charge 7 during launch from a weapon are in an advantageous way taken up by the supporting conical surface of the central portion 5 in cooperation with adjacent bottom surface and the internal cylindrical wall surface of the housing 1. As a result of the adequate support given to the gun powder charge 7 at its lower portion, formation of cracks in the gun powder charge 7 can be substantially completely avoided, which otherwise changes the effective combustion surface and thus gas generation and combustion time, resulting in a considerably increased dispersion with regarding to trajectory length. Furthermore, this adequate support also facilitates use of a more powerful drive charge in the weapon, and thus increased acceleration and increased muzzle speed, which in combination with obtained base-bleed-action results in an extremely long trajectory range, something which is most desirable. The igniter charge 4 of the shown embodiment is arranged with a lidshaped member 8, arranged with a number of through holes 9, 9', inclined in direction outwards, which divide the combustion flame of the igniter charge 4 into a number of flames directed towards the gun powder charge 7. Said lidshaped member 8 can obviously also be excluded while maintaining a completely acceptable igniting effect.

With regard to the igniter charge 4, same is shown located in a central through hole in the rear wall 3, and including a surrounding tubular member having a diametrically enlarged outer portion, which, for example, is connected to the rear wall 3 by means of a screw thread.

such an embodiment has obvious advantages from manufacturing point of view, and also facilitates easy mounting/demounting of the igniter charge 4, e.g. when replacement is called for after a long period of time in storage.

However, the igniter charge 4 can also be located in a bottom hole, open in direction towards the projectile body 2, into which the igniter charge 4 has been pressed down or attached in any other way.

Even though the shown embodiment with a central portion 5 integrated with the rear wall 3 is a preferred embodiment, the central supporting member FIG. 1B, may obviously also be arranged as a separate member, preferably attached to the rear wall 3. In such an embodiment, the central member S may also be arranged as a conical collar shaped member, for example attached by means of a co-acting groove taken up by the internal surface of the rear wall 3, into which the collar shaped member is insertable with a drive fit FIG. 1A.

In the above discussed embodiments, the supporting surface for the gun powder charge 7 has been stated as a conical surface, but same can obviously also have a somewhat curved shape, e.g. slightly concave or convex. However, from manufacturing point of view, a conical arrangement is preferred.

A further improvement is accomplished by arranging the outer surface of the igniter charge 4 insulated by, for example, a thin foil or a membrane 10. It is hereby avoided that the chemical composition of the gun powder charge 7 and the igniter charge 4 should negatively influence each other. Said insulation may, for example, comprise of a thin aluminum foil, which during the storage period of the base bleed unit prevents substances included in the igniter charge 4 and the gun powder charge 7 from influencing each other in a negative fashion. When the drive charge of a projectile is exploded, the protective foil is burned away, and the outer surface of the igniter charge 4 is exposed and ignited in intended fashion.

Even though location of the igniter charge 4 in an opposed relationship to the rear wall 3 is not a preferred embodiment, such an embodiment can obviously be used in connection with the features disclosed in claim 1, i.e. with an internal supporting member S for the gun powder charge 7. In such an embodiment, the rear wall 3 can alternatively be arranged with a centrally located outlet nozzle, or with a number of circularly spaced outlet holes 6, 6'. Furthermore, the present invention can also be modified and adapted to other known types of base bleed units, and it is thus in no way restricted to the example of an embodiment shown and described.

Shown and described embodiments are thus only intended to serve as examples of preferred embodiments according to the invention, and may thus be further modified and combined within the scope of the inventive thought and the following claims.

What is claimed is:

1. Base bleed unit comprising a housing surrounding at least one mass flow generating gun powder charge, and having a plurality of outlet holes extending through a rear wall of the housing surrounding a substantially centrally arranged igniter charge adjacent to said rear wall, a centrally located member having substantially the shape of a truncated cone, being arranged extending from an internal surface of the rear wall, arranged abutting a portion of the mass flow generating gun powder charge adjacent in relation to the rear wall, the outlet holes and the igniter charge being located within the member.

2. Base bleed unit according to claim 1, wherein the centrally located member extending from the internal surface of the rear wall comprises a member integrated with the rear wall.

3. Base bleed unit according to claim 1, wherein the centrally located member extending from the internal surface of the rear wall comprises an individual member attached to the rear wall.

4. Base bleed unit according to claim 1, wherein the igniter charge is located in a bottom hole formed from a part of the centrally located member from which the outlet holes extend.

5. Base bleed unit according to claim 1, wherein the rear wall of the housing and the centrally located member are arranged with a substantially centrally located through hole, in which the igniter charge is mountable and demountable from an outside plane of the rear wall.

6. Base bleed unit according to claim 5, wherein the igniter charge is arranged having a surrounding tubular member with at least two other different external diameters, and with a larger diameter adjacent to the outside plane of the rear wall (3).

7. Base bleed unit according to claim 1, wherein a portion of the central member extending from the internal surface of the rear wall comprises a substantially collar shaped member.

8. Base bleed unit according to claim 7, wherein said collar shaped member is integrated with the central member.

9. Base bleed unit according to claim 7, wherein said collar shaped member comprises an individual member, attached to the central member or the rear wall.

10. Base bleed unit according to claim 1, wherein a free end surface of the igniter charge is covered by a thin foil or membrane which is removed under influence from hot combustion gases from the igniter charge whereby a projectile is launched.

* * * * *